United States Patent [19]

Swain

[11] 4,010,916

[45] Mar. 8, 1977

[54] DEVICE FOR PROVIDING PROPER LAYING OF CABLE ON THE DRUM OF A CRANE

[76] Inventor: Fabian F. Swain, Kingsley, Iowa 51028

[22] Filed: Sept. 24, 1975

[21] Appl. No.: 616,507

[52] U.S. Cl. ..... 242/157.1; 242/158.3

[51] Int. Cl.[2] ..... B65H 57/28

[58] Field of Search ..... 242/157.1, 158 R, 158.3; 254/190 R

[56] References Cited

UNITED STATES PATENTS

| | | | |
|---|---|---|---|
| 241,747 | 5/1881 | Stover | 242/158.3 |
| 808,424 | 12/1905 | Wyckoff et al. | 242/158.3 X |
| 905,329 | 12/1908 | Krause | 242/158.3 X |
| 913,564 | 2/1909 | Riblet | 242/158.3X |
| 2,305,045 | 12/1942 | Torrence | 242/158.3 |

FOREIGN PATENTS OR APPLICATIONS

| | | | |
|---|---|---|---|
| 89,278 | 5/1957 | Norway | 242/157.1 |

*Primary Examiner*—Stanley N. Gilreath

[57] ABSTRACT

A device for use with a crane to provide proper laying of the cable on the winding drum. The device includes a positively controlled guide sheave to guide the cable onto the drum.

3 Claims, 4 Drawing Figures

DEVICE FOR PROVIDING PROPER LAYING OF CABLE ON THE DRUM OF A CRANE

BACKGROUND AND SUMMARY OF THE INVENTION

This invention pertains to hoisting devices and particularly to the type of device used for automobile wreckers, in which a cable runs from a drum over at least one sheave which serves to change the direction of the cable before it is effective to lift the weight to which it is attached.

In many auto wrecker hoists and tow cars, particularly those designed for hauling heavier units such as trucks, the principal lifting cable is wound on a drum located close to the cab of the truck on which the unit is mounted. From the drum the cable passes upward in a near vertical direction to a level from which the cable can run nearly horizontally to a sheave from which the cable runs out to the object to be lifted or towed.

It is obviously desirable that the cable lie in even layers on the drum. If the run of cable from the drum to the first sheave is relatively long, the angle at which the cable meets the drum is nearly uniform as the cable is wound onto the drum. In that situation, the cable usually will wind onto the drum reasonably uniformly. However, when the distance between the drum and the first sheave is relatively short, then the angle at which the cable meets the drum can vary considerably. When this happens, there is much less likelihood that the cable will wind onto the drum properly.

In the auto wrecker type of device, the chain ordinarily is at the level of the bed of the truck on which the crane is mounted. From the drum the cable runs upward about to the median level at which the top of the lifting boom might be used. Ordinarily that distance is not great and so the tendency of the cable is to bunch up in the middle of the drum.

Various devices have been used to cure the problem. Among the devices have been idler sheaves each having a variably sloping axle which is designed to tilt back and forth to cause the idler to run back and forth on the axle to cause the cable to wind properly on the drum.

By my invention, I provide a positively actuated idler sheave enclosed in a portion of the structure of the crane. The rotation of the sheave by the cable as it is let out or pulled in causes the sheave to move across its axle and thereby to guide the cable off from or onto the drum. Thus, the device is self driven without the need for any outside actuation to cause it to operate properly.

FIGURES

Figure 1:
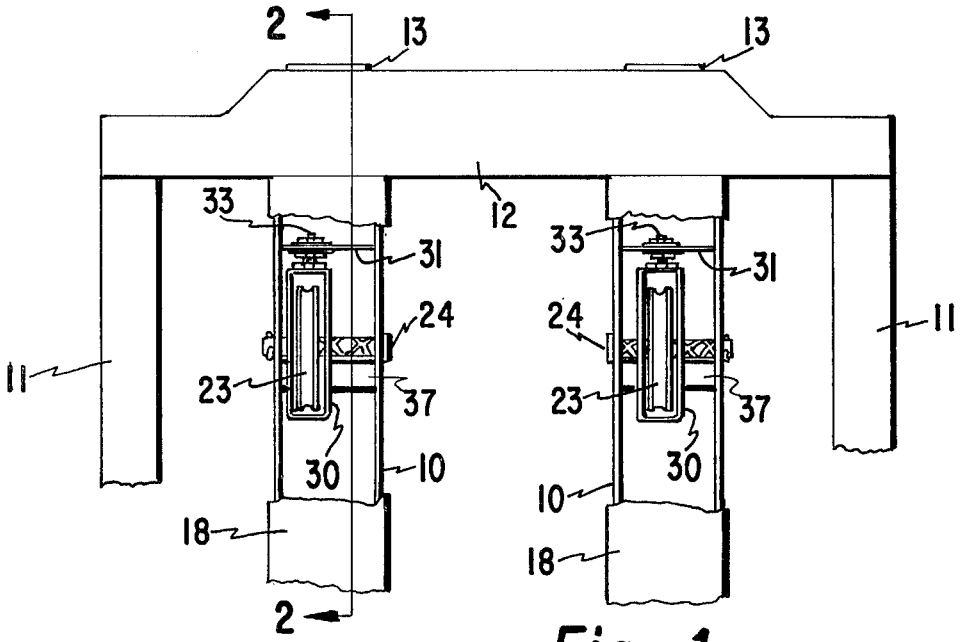
Figure 2:
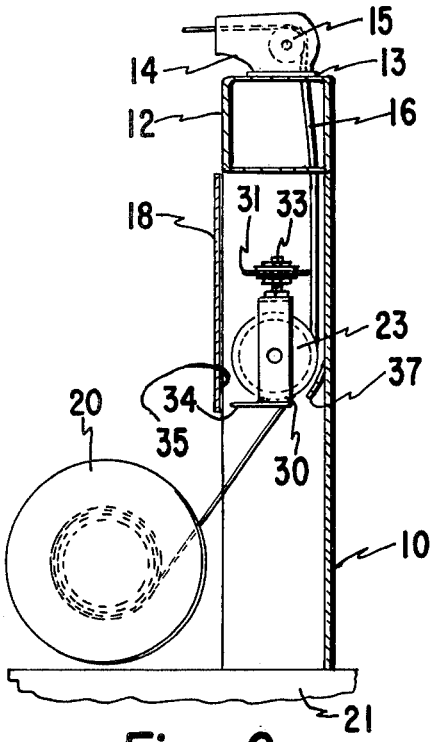
Figure 3:
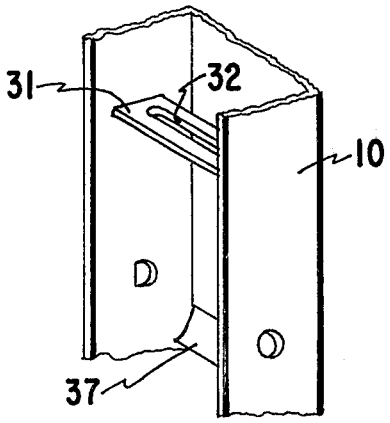
Figure 4:
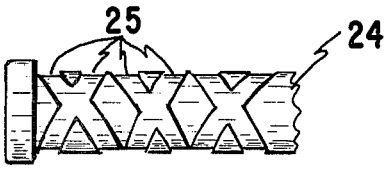

FIG. 1 is a rear elevational view of a part of the structure of a wrecker with part being broken away to show the idler sheave, FIG. 2 is a sectional view from line 2—2 of FIG. 1, FIG. 3 is a detailed pictorial view of a part of the structure to illustrate the guide members, and FIG. 4 is a detailed view, to an enlarged scale of a portion of the actuating axle.

DESCRIPTION

Briefly, my invention comprises a means for causing the cable of a crane, such as that used on an auto wrecker, to be laid down on the drum as nearly level as possible. It does this by use of an idler sheave operating on a cross-threaded axle which causes the sheave to traverse the axle longitudinally as the sheave is rotated.

More specifically, and referring to the drawings, my device is mounted within upright members 10 of the structural framework of an auto wrecker crane. This framework may also include other fixed upright parts 11 and a transverse member 12. At the upper end of each of the uprights 10, the transverse member 12 is provided with a collar 13 on which may be mounted a pivoting elbow 14. A pulley 15 is mounted in the elbow 14 to provide for the change in direction of the cable 16 which is used to pull or raise the workpiece which the crane is to pull or lift. The elbow 14 is mounted in the collar 13 so that it can turn through full circle or nearly that.

The upright 10 may be formed of a box shaped hollow steel member or a deep channel shape over which a cover 18 may be fitted so that the mechanism may be enclosed to protect it from dust, dirt, precipitation, etc. The elbows 14 also serve this protective function.

A winch having a drum 20 may be mounted on the platform 21 of the crane. The drum is the usual type of winch spool on which the cable 16 may be wound as it is pulled in. The drum may be power driven from the engine of the truck on which the crane is mounted or by some auxiliary motive power as is well known in the art.

Between the drum 20 and the pulley 15 in the elbow 14, the cable 16 is run over an idler sheave 23. This sheave is journalled on a cross threaded axle 24 which is kept from rotation in its mounting in the member 10. The holding may be accomplished by any preferred means such as a keyway and key, splines, a flat side on the part of the axle engaging the upright or any means which may be convenient. A dog or peg (not shown) within the hub of the sheave is adapted to run in the threads or grooves 25 on the axle 24. It will be apparent that as the sheave is rotated by the cable running over it, the sheave will be driven from one end of the axle 24 to the other. This action causes the cable to be laid evenly on the drum 20.

In order to provide adequate guiding for the cable 16 over the sheave 23, and to provide smooth operation of the sheave, I prefer to enclose the sheave in a guard frame 30. This frame is a rectangular open frame enclosing the sheave and smoothly slidable over the axle 24. In order to prevent rotation of the frame, I provide a guide member 31 fixed to the inner surface of the upright 10 and formed with a slot 32. A guide rod 33 on the frame 30 is adapted to slide back and forth within the slot as the sheave 23 is driven by the axle. The rod 33 may be threaded and provided with nuts and washers or similar fastenings to hold the rod 33 properly placed within the slot 32. Also, the bottom member of the frame may have an extended lip 34 adapted to slide along the front wall 35 of the upright 10. This also prevents the rotation of the frame 30 and keeps it properly aligned. The frame 30 is moved axially of the axle 24 solely by the pressure of the side of the sheave 23 against the frame. I envision the possibility of using a hub on the sheave to contact the frame 30 near the axle 24 so as to provide less interference with the rotation of the sheave 23, but in my experience, I have found a hub unnecessary.

The cable 16 must be kept within the groove in the sheave 23. To do this, a guide should be provided. This may take the form of a member on the frame 30, but I prefer to use a curved guide piece 37 fixed to the upright 10. This piece should have a curvature of about the same radius as the sheave 23 and should be close enough to the rim of the sheave to prevent the cable from jumping out of the grooves in the sheave. From this guide, the cable goes upward through the open space between the guide member 31 and the rear wall of the upright 10. Thus, the cable is guided not only across the sheave but within the upright as well.

The operation of the device should be obvious from the foregoing description. It should be apparent that I have provided an improved means for guiding a cable for a crane from the winding drum to the hoist because of the provision of an adequately guarded means for laying the cable smoothly on the drum.

I claim:

1. In combination with a hoist including a platform, power-driven drum means rotatably mounted on said platform, a hoist cable attached to said drum means and adapted to be wound onto said drum means, and upright means on said platform through which said cable is adapted to run; means for guiding said cable onto and off from said drum comprising: a cross-threaded axle fixed in said upright means having an axis substantially parallel to that of said drum means and adjacent to said drum means, a sheave wheel rotatably mounted on said axle and laterally movable thereon, said sheave wheel having a part engaged in the threads on said axle so that rotation of the wheel causes a back and forth axial movement across said axle, framework means surrounding said sheave wheel and having parts adjacent the sides of said sheave wheel near said axle, said framework means including a guide rod extending therefrom, said guide rod being engaged with part of said upright means to guide said framework means, said sheave wheel being engageable with said framework means to that movement of said wheel is effective to move said framework means, said framework means also including lip means extending therefrom, said lip means extending adjacent to and being slidable along a part of said upright means.

2. The device of claim 1 in which fixed guide means is attached to said upright means adjacent said sheave wheel closely enough to prevent the cable from being dislodged from the groove in said sheave wheel.

3. The device of claim 2 in which said fixed guide means is curved so that its surface is substantially concentric with said sheave wheel.

* * * * *